United States Patent [19]

Padgett

[11] 4,043,279

[45] Aug. 23, 1977

[54] SECURITY BOX

[76] Inventor: James M. Padgett, 1065 Reading Road, Mason, Ohio 45040

[21] Appl. No.: 637,376

[22] Filed: Dec. 3, 1975

[51] Int. Cl.[2] ..... E05G 1/04

[52] U.S. Cl. ..... 109/50; 70/140; 109/70

[58] Field of Search ..... 109/50, 52, 64, 69, 109/70; 70/140

[56] References Cited

U.S. PATENT DOCUMENTS

| | | | |
|---|---|---|---|
| 990,469 | 4/1911 | Anderson | 109/70 |
| 1,023,425 | 4/1912 | Harrison | 109/50 X |
| 2,584,708 | 2/1952 | Jenkins | 70/140 X |

FOREIGN PATENT DOCUMENTS

| | | | |
|---|---|---|---|
| 60,412 | 12/1924 | Sweden | 109/70 |
| 7,250 | 2/1894 | United Kingdom | 109/52 |

*Primary Examiner*—Paul R. Gilliam
*Assistant Examiner*—David H. Corbin
*Attorney, Agent, or Firm*—Wood, Herron & Evans

[57] ABSTRACT

A wall type security box sized to fit between, and to be fixed to, adjacent studs in a wall opening. The box is locked by a lock device in the form of an elongated rod having a key cylinder on one end and screw threads on the other end. After closure of the security box's door, and by manually gripping a key in the lock device's key cylinder, the elongated rod is, first, extended through a grooved bore in the box's face wall on one side of the box's access opening, second, extended through a through bore in the door, and third, rotated into threaded relation with a threaded bore in the box's face wall on an opposite side of the access opening. Preferably these bores are all axially aligned one with the other when the door is closed. The key is then removed to extend the cylinder's spring loaded lugs into latching relation with axial grooves in the grooved bore below the access opening, thereby preventing further rotation of the elongated rod and locking the security box. Opening of the door is accomplished by reversing the lock device's use step sequence.

14 Claims, 5 Drawing Figures

SECURITY BOX

This invention relates to security boxes. More particularly this invention relates to a novel and improved security box which, in preferred form, is adapted to be installed in a wall.

Security boxes of the type adapted to be wall mounted are well known to the prior art. Such security boxes all basically include a box housing, a door to the housing, a lock mechanism for securing the door in closed position, and mounting structure for fixing the security box in place on a wall. Such security boxes find use in homes, in apartments, and the like. In earlier years, security boxes were generally used in residences only for very valuable personal property, e.g., jewels and the like. However, in this day and age security boxes are commonly used for the safekeeping of personal papers and effects of nominal worth, as well as personal property of substantial worth. One of the major components of a security box is, of course, the lock mechanism associated with the box's door. And, as a general rule, the more expensive security boxes use complex lock mechanisms in an effort to insure against unauthorized entry. If a security box is to be used only for personal property of less than substantial worth, however, a complex lock mechanism is not necessary.

Accordingly, it has been one objective of this invention to provide an improved and novel wall type security box that does not require a complex key or combination lock mechanism, thereby providing a less costly security box that is available to a wide range of potential users.

It has been another objective of this invention to provide a security box which includes a novel door and door lock mechanism that is effective in preventing unauthorized entry, yet is relatively economical to manufacture.

In accord with these objectives, the security box of this invention may be sized to fit between, and to be fixed to, adjacent studs in a wall openings. The box is locked by a lock device in the form of an elongated rod having a key cylinder on one end and screw threads on the other end. After closure of the security box's door, and by manually gripping a key in the lock device's key cylinder, the elongated rod is, first, extended through a grooved bore in the box's face wall on one side of the box's access opening, second, extended through a through bore in the door, and third, rotated into threaded relation with a threaded bore in the box's face wall on an opposite side of the access openings. Preferably these bores are all axially aligned one with the other when the door is closed. The key is then removed to extend the cylinder's lugs into latching relation with axial grooves in the grooved bore below the access opening, thereby preventing further rotation of the elongated rod and locking the security box. Opening of the door is accomplished by reversing the lock device's use step sequence.

Further objectives and advantages of this invention will be more apparent from the following detailed description taken in conjunction with the drawings in which.

Figure 1:
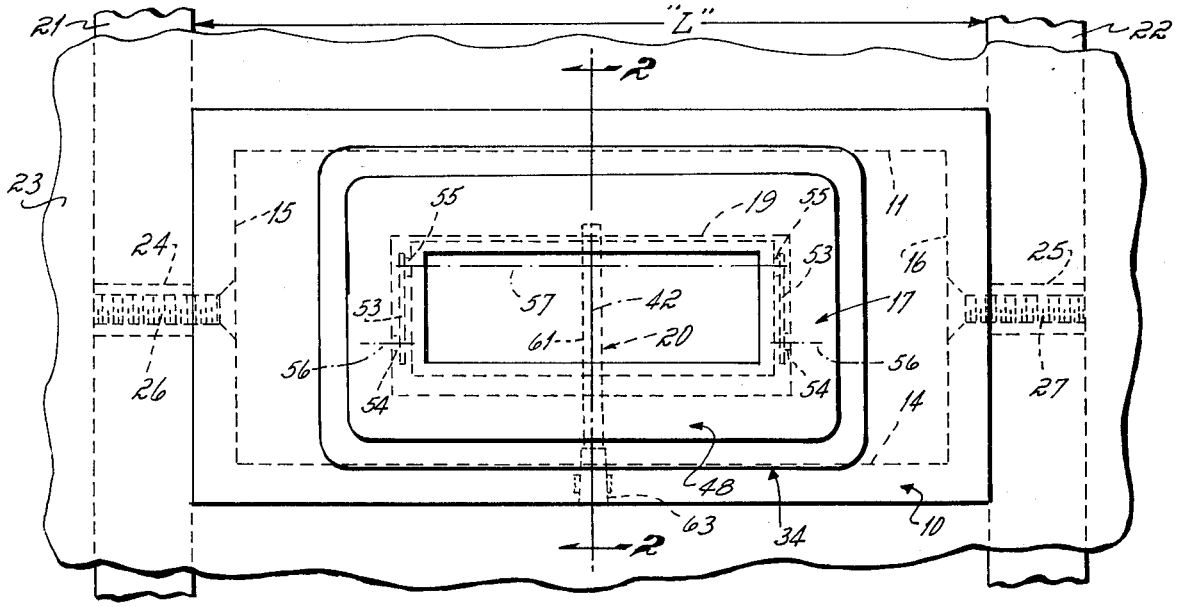
FIG. 1 is a front view illustrating a security box structured in accord with the principles of this invention, the box being shown mounted between adjacent vertical studs in a wall.

As shown in the Figures, the security box 10 of this invention basically includes a face wall 11, a rear wall 12, a top wall 13, a bottom wall 14, and opposed side walls 15, 16, same constituting the box's housing. A door 17 is pivotally mounted to the box's housing in face wall 11 to permit ingress and egress from the box's interior cavity 18 through access opening 19. A lock device 20 cooperates with the door 17 and the housing's face wall 11 to maintain the box in a secured or locked attitude when the door is closed and the lock device is activated.

Figure 2:
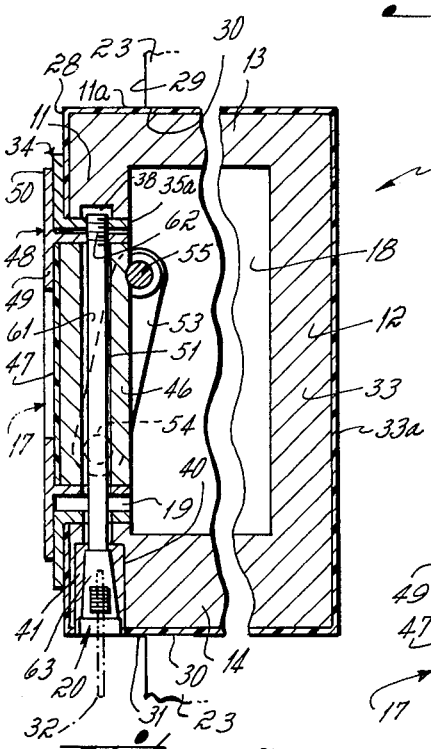
FIG. 2 is a cross-sectional view taken along lines 2—2 of FIG. 1.

The security box 10 is sized lengthwise L so as to fit between opposed or adjacent studs 21, 22 of a vertical wall 23, see FIG. 1. A wall 23 with spaced studs 21, 22 as shown may be commonly found in single or multi-family homes, apartment buildings and the like. Such wall studs 21, 22 are, of course, spaced apart a standard distance in usual practice so that the box's length L can be made of a standard length. Anchors 24, 25 are installed in the adjacent and opposed studs 21, 22, and screw bolts 26, 27 are used to mount the security box 10 in fixed vertical relation with the studs and, hence, with the wall, i.e., the screw bolts are threadedly connected with the anchors in the studs. This, of course, locates and maintains the entire security box 10 in vertical relation on the wall 23. Note particularly, as illustrated in FIG. 2, that the security box 10 is not fully mounted within the wall, i.e., that the front face 28 of the security box is not flush or coplanar with the wall's face 29. The security box is mounted in the wall opening 30 such that same extends slightly outwardly from the wall's face 29 to define a peripheral well portion **11*a*. This for the reason that access to the lock device 20 for the security box's door 17 is from the box's bottom face 31, and access to the lock device by a hand operated key 32** must be provided.

Figure 3:
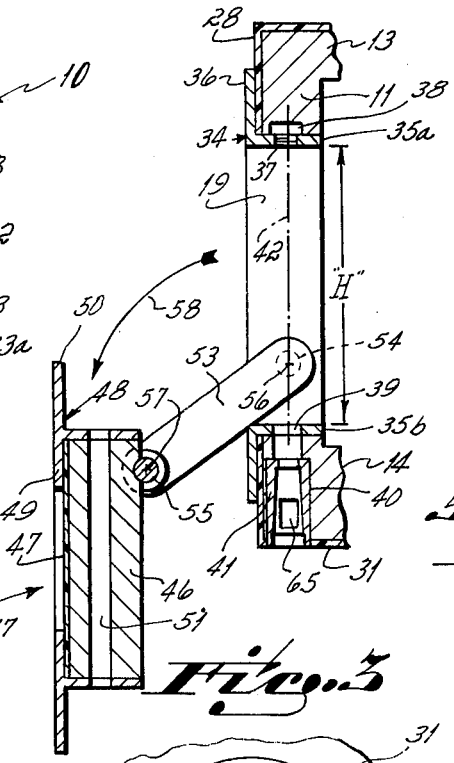
FIG. 3 is a partially broken away view similar to FIG. 2 but showing the security box's door in the open attitude.

The housing of the security box 10, as previously mentioned, includes face wall 11, rear wall 12, top wall 13, bottom wall 14, and side walls 15, 16. The walls 11–16 of the security box are fabricated from wood 33, and are encased in a plastic sheath or casing **33*a*. The interior cavity 18 of the box 10 may be provided with whatever covering is desired from an aesthetic point to make same acceptable to the user. The access opening 19 to the security box 10 is provided with a metal frame 34 that extends around the periphery of same, the frame being fabricated of right angle configured structural members. The access opening frame's inwardly extending lip 35 covers the access opening's edges, and the frame's outwardly extending lip 36 overlies the box's face wall 11 and extends outwardly thereon from the access opening 19. A threaded bore 37 is provided in the metal frame's top lip 35*a* centrally thereof along the top edge of the access opening 19, that bore opening into a small depression 38 cut out in the face wall 11 above the metal frame's top lip, all as shown in FIGS. 2 and 3. Also, the metal frame's bottom lip 35*b* is provided with a non-threaded bore 39 centrally thereof along the bottom edge of the access opening 19, the non-threaded bore being vertically positioned directly beneath the threaded bore 37, see FIG. 1. Further, and importantly, the face wall 11 of the box's housing includes a stepped bore 40 adapted to receive a metal insert 41 in seated relation, that stepped bore extending through the face wall from the bottom face 31 of the housing to the bottom edge of the access opening 19. The axes of threaded bore 37, non-threaded bore 39, and stepped bore 40 all lie on a common bore axis 42, that axis being vertical, equally spaced between side walls 15, 16, and parallel to the front face 11 of the housing, all shown in FIGS. 1 and 3**.

The construction of the door for the security box 10 is particularly illustrated in FIGS. 2 and 3. The door 17 is, of course, in the face or exposed wall 11 of the security box, and is structured of wood 46 with a plastic sheath 47 thereon. A metal door frame 48, which is fabricated of a T-shaped structural member, surrounds the door's periphery. The T-shaped metal door frame 48 includes an inwardly extending lip 49 which overlies the door's exterior face, and an outwardly extending lip 50 which extends outwardly away from the door's peripheral edges. The door 17 is provided with a bore 51 from the top edge to the bottom edge therethrough, the through bore 51 being positioned so as to be coaxially aligned on axis 42 with the threaded bore 37 in the access opening's top edge, and with the stepped bore 40 at the bottom of the face wall, when the door is closed. The door frame's outwardly extending lip 50 cooperates with the access opening frame's outwardly extending lip 36 to locate the door's through bore 51 in coaxial alignment with the threaded bore 37 in the access opening's top edge, and with the stepped bore 40, as the door 17 is closed, see FIG. 2. Such permits use of the lock device 20 as is described in detail below.

The door 17 is connected to the box's housing by hinge arms 53, one arm being disposed on each side of the door. Each hinge arm 53 is connected to a side edge of the box's access opening 19 adjacent the bottom edge thereof by a first pivot pin 54, and is connected to the rear face of the door 17 adjacent the top edge thereof by a second pivot pin 55. The pivot pins 54 and 55, respectively, for the respective hinge arms 53 are coaxially disposed, thereby defining a fixed 56 and a movable 57 hinge axis for the door 17. The hinge axes 56, 57 are parallel one to the other, and are perpendicular relative to the bore axis 42, as shown in FIG. 1. The hinge arm 53 connection of the box's door 17 with the box's housing permits the door to swing outwardly and downwardly relative to the box's housing along an arcuate travel path as indicated by arrow 58 upon opening same for user access. Of course, and when closing the box's door 17, same is simply swung upwardly and inwardly in the reverse of that travel path 58 so as to locate the door in closed relation with the box's housing (and, thereby, to align bores 37, 51 and 40) as illustrated in FIG. 2.

Figure 4:
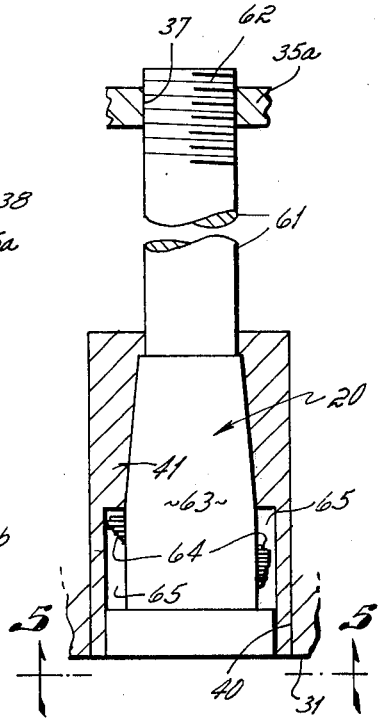
FIG. 4 is a partially broken away detail view showing the lock device for the security box of this invention.
Figure 5:
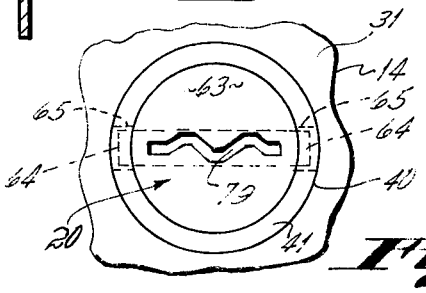
FIG. 5 is a view taken along line 5—5 of FIG. 4.

The lock device 20 which maintains the door in a secured relation with the box's housing is particularly illustrated in FIGS. 2 and 4. The lock device 20 is demountable or removable from the box's housing wen the security box is opened. As shown in those FIGS., the lock device 20 includes an elongated rod 61 of a length adapted to span and extend beyond the height H of access opening 19. The elongated rod 61 is provided with threads 62 at one end adapted to threadedly engage the threaded bore 37 provided in the top edge of the box access opening's metal frame 34. A lock or key cylinder 63 is immobily fixed to the other end of the rod 61, the cylinder including two opposed sets of lugs 64. The tapered lock cylinder 63 is adapted to seat in a fitted relation within tapered insert 41, which is fixed in place in the housing's face wall 11, when the rod 61 is fully extended into the housing in locking relation therewith. The tapered insert 41 is provided with a pair of axial grooves 65 on opposed sides thereof, the axial grooves being positioned to interact with the two sets of lugs 64.

The cylinder's lugs 64 are spring loaded outwardly, are adapted to retract within the key cylinder 63 against that spring bias upon insertion of key 32 into the cylinder's key slot 79, and are adapted to extend outwardly from the key cylinder in response to the spring bias upon withdrawal of the key 32. The spring loaded lugs 64 remain retracted only as long as the key 32 remains within the cylinder 63. In other words, the cylinder's lugs 64 are adapted to be extended and retracted relative to the periphery of the key cylinder 63 depending on whether key 32 is removed form or positioned within, respectively, the key cylinder. This key cylinder construction is known to the prior art, and is commonly referred to in the trade as a Chicago lock. The lock device 20, therefore, constitutes an elongated rod 61 and a key cylinder 63 one-piece structure adapted to be inserted into and withdrawn from an elongated bore 40, 51 having a threaded seat 37 at the top end. This elongated bore is defined by the top edge **35*a* of the box access opening's metal frame 34, by through bore 51 which extends widthwise through the door 17 from the top edge to the bottom edge thereof, and by key cylinder bore 40 which extends through the box's face wall from the bottom edge of the box's access opening 19 to the bottom face 31** of the box's housing.

In use, and as illustrated in FIGS. 1 and 2, the integrity of the security box is maintained when the door is fully closed and locked by the lock device 20. In this attitude, the door's hinge arms 53 are inaccessible and not visible, and the box's interior cavity 18 is also inaccessible, because the outwardly extending lip 50 of the door's metal frame 48 overlies the outwardly extending lip 36 of the access opening's metal frame 34, all as shown in FIG. 2. The door is maintained in the closed and locked attitude by the lock device's elongated rod 61 which extends through and is seated in the face wall's insert 41, which extends through the bore 51 in the door 17, and which is turned into threaded relation with the tapped bore 37 in metal frame's lip **35*a* at the top edge of the access opening 19, see FIG. 2. The lock device's elongated rod 61 cannot be rotated out of threaded engagement with that threaded bore 37 after key 32 has been removed from the key cylinder 63 as removal of the key permits the spring loaded lugs 64 to extend outwardly into the axial grooves 65 provided in the insert 41 when the lugs are aligned with those grooves, see particularly FIG. 4. In other words, and in the FIGS. 2 and 4 attitude, the elongated rod 61 and key cylinder 63 combination cannot be rotated so as to threadedly disengage the elongated rod from the box access opening's metal frame 34 at the top edge 35*a* thereof and therefore, the lock device 20 cannot be disengaged from the box's door. Such, or course, preserves the security of the box's interior cavity 18**.

When a user desires to open the security box 10, a key 32 is first manually inserted through key slot 79 into the key cylinder 63 as shown in phantom lines in FIG. 2. The key slot 79 of the key cylinder 63 is located on the underneath face 31 of the security box 10, hidden from the view of a casual observer. The key 32, as same is inserted into the cylinder lock 63, retracts the lugs 64 from latched engagement with the axial grooves 65 against the lugs' normally outward spring bias. As soon as the lugs 64 have been so retracted by insertion of the key, the key cylinder 63 and elongated rod 61 structure are then jointly rotated so as to disengage the threaded end 62 of the rod from the threaded bore 37 in the access opening frame's top edge 35*a*. Such rotation of the lock device 20 structure is accomplished using the key 32 (which remains in the key cylinder 63 after retraction of the lugs 64) as the handle to effect that rotation.

Once the lock device 20 has been threadedly disengaged from the top edge 35*a* of the access opening's metal frame 35, the elongated rod 61/key cylinder 63 structure is simply drawn downwardly out of the bores 51, 40 along centerline 42, thereby permitting the door 17 to swing outwardly and downwardly into the box-open position illustrated in FIG. 3 after the lock device has been completely withdrawn.

When it is desired once again to lock the door 17 in the secured or closed position shown in FIG. 2, the reverse of the opening step sequence is used. In other words, the door 17 is first closed until its bore 51 is aligned with the key cylinder bore 40 in the bottom portion of the face wall 11 and the tapped bore 37 in the top portion of the face wall. The lock device 20 structure is then inserted until the threaded end 62 of the rod 61 can be screwed into the tapped bore 37. With the key 32 in operating relation with the key cylinder 63 (so that spring loaded lugs 64 are retracted), and with the key being used as a handle, the lock device 20 is then rotated so as to threadedly engage the threaded end 62 of the rod 61 into the tapped bore 37 until the key cylinder 63 seats in mated relation with the metal insert 41 at which location the lugs 64 are aligned with axial grooves 65, see FIG. 4. The lugs 64 of the key cylinder 63 are then extended by removal of the key 32 from the cylinder thereby seating the lugs 64 in axial grooves 65. Since the key 32 is operable to extend and retract the lugs 64 when inserted or removed from the slot 79, the angular position of the key and slot relative to the wall face 29 will indicate to the user that the lugs 64 are in alignment with the slots 65 so that the key can be withdrawn to secure the box.

Having described in detail the preferred embodiment of my invention, what I desire to claim and protect by Letters Patent is:

1. A security box adapted to be mounted in a building wall, said box comprising a box housing including an access opening in the front face of said housing, said housing defining two bores therein, each of said bores communicating with said access opening, and one of said bores being threaded, a door selectively operable with said housing to open and close said access opening, said door defining a bore therethrough from one edge to another, one of said housing's two bores communicating with one end of said through bore when said door is closed, and the other of said housing's two bores communicating with the other end of said through bore when said door is closed, a hinge arm pivotally mounted at one end to said housing on a fixed hinge line, and pivotally mounted at the other end to said door on a movable hinge line, said movable hinge line being movable relative to said housing when said door is opened relative to said access opening, said hinge lines being substantially parallel one to the other, and said fixed hinge line being located adjacent the bottom edge of said access opening, and said movable hinge line being located adjacent the top edge of said door, the location of said hinge lines causing said door to drop beneath said access opening when said door is opened, and a lock device selectively engageable with said housing and said door to lock same in the closed attitude, said lock device including an elongated rod extending through said door's through bore and into said two housing bores when said door is in locked relation with said housing, said elongated rod being positioned substantially normal to said door hinge lines when said door is closed and locked, threads on one end of said elongated rod, said elongated rod being threadedly received in said threaded bore when said door is in locked relation with said housing, and a lock cylinder fixed to the other end of said elongated rod, said lock cylinder's lug being selectively operable to prevent rotation of said rod when said door is in locked relation with said housing, thereby preventing disengagement of said rod from said threaded bore after locking relation has been established.

2. A security box as set forth in claim 1 wherein the other bore in said housing is provided with at least one groove substantially longitudinally of the axis thereof, and wherein said lock cylinder's lug is spring loaded outward relative to said lock cylinder, withdrawal of a key from said lock cylinder permitting said lug to spring outward to enter said housing bore's groove for preventing further rotation of said rod, and insertion of a key into said lock cylinder causing said lug to withdraw thereunto against said spring bias to permit rotation of said rod for disengaging said lock device from said door.

3. A security box as set forth in claim 1, said box housing being sized lengthwise to fit between two studs in said wall, and including anchor means adapted to cooperate with each side wall of said housing and that stud adjacent each side wall to mount said security box in fixed position in said wall.

4.

A security box as set forth in claim 1, the face wall of said housing being positioned to extend outward away from said building wall when said box is mounted in said wall so as to define a peripheral wall portion on said housing, said lock device extending inwardly into said housing through said peripheral wall portion of said housing, and said lock cylinder's exterior surface not extending out beyond the exterior surface of said peripheral wall portion for eliminating view of said lock cylinder by a casual observer.

5. A security box as set forth in claim 1 including a frame fixed around the periphery of said door, said frame having an outwardly extending lip adapted to overlie the exposed face of the front face of said housing, thereby aligning said bores prior to receipt of said lock device in locking relation with said security box.

6. A security box as set forth in claim 2 wherein said threaded bore, said door bore, and said grooved bore are substantially coaxially aligned.

7. A security box adapted to be mounted in a building wall, said box comprising a box housing including an access opening in the face wall of said housing, the face wall of said housing being positioned to extend outward away from said building wall when said box is mounted in said wall so as to define a peripheral wall portion on said housing, said housing defining two bores therein, each of said bores communicating with said access opening, one of said bores being threaded, and the other of said bores communicating with said peripheral wall portion of said housing, a door selectively operable with said housing to open and close said access opening, said door defining a bore therethrough from one edge to another, one of said housing's two bores communicating with one end of said through bore when said door is closed, and the other of said housing's two bores communicating with the other end of said through bore when said door is closed, and a lock device selectively engageable with said housing and said door to lock same in the closed attitude, said lock device extending inwardly into said housing through said peripheral wall portion of said housing, said lock device including an elongated rod extending through said door's through bore and into said two housing bores when said door is in locked relation with said housing, threads on one end of said elongated rod, said elongated rod being threadedly received in said threaded bore when said door is in locked relation with said housing, and a lock cylinder fixed to the other end of said elongated rod, said lock cylinder's lug being selectively operable to prevent rotation of said rod when said door is in locked relation with said housing for preventing disengagement of said rod from said threaded bore after locking relation has been established, and said lock cylinder's exterior surface not extending out substantially beyond the exterior surface of said peripheral wall portion for eliminating view of said lock cylinder by a casual observer.

8. A security box as set forth in claim 7 wherein the other bore in said housing is provided with at least one groove substantially longitudinally of the axis thereof, and wherein said lock cylinder's lug is spring loaded outward relative to said lock cylinder, withdrawal of a key from said lock cylinder permitting said lug to spring outward to enter said housing bore's groove for preventing further rotation of said rod, and insertion of a key into said lock cylinder causing said lug to withdraw thereunto against said spring bias to permit rotation of said rod for disengaging said lock device from said door.

9. A security box as set forth in claim 7 including a frame fixed around the periphery of said door, said frame having an outwardly extending lip adapted to overlie the exposed face of the front face of said housing, thereby aligning said bores prior to receipt of said lock device in locking relation with said security box.

10. A security box as set forth in claim 8 wherein said threaded bore, said door bore, and said grooved bore are substantially coaxially aligned.

11. A security box as set forth in claim 7 including a hinge arm pivotally mounted at one end to said housing on a fixed hinge line, and pivotally mounted at the other end to said door on a movable hinge line, said movable hinge line being movable relative to said housing when said door is opened relative to said access opening.

12. A security box as set forth in claim 11 wherein said hinge lines are substantially parallel one to the other, said fixed hinge line being located adjacent the bottom edge of said access opening, and the movable hinge line being located adjacent the top edge of said door.

13. A security box as set forth in claim 12 said elongated rod being linear, and said hinge lines being positioned substantially normal to said elongated rod.

14. A security box as set forth in claim 7 said box housing being sized lengthwise to fit between two studs in said wall, and including anchor means adapted to cooperate with each side wall of said housing and that stud adjacent each side wall to mount said security box in fixed position in said wall.

* * * * *